United States Patent [19]

Munro

[11] 3,930,308

[45] Jan. 6, 1976

[54] SUBSTRATE CONNECTORS

[75] Inventor: Geoffrey Hector James Munro, Guernsey, Channel Islands

[73] Assignee: AMP Incorporated, Harrisburg, Pa.

[22] Filed: Sept. 3, 1974

[21] Appl. No.: 502,996

Related U.S. Application Data

[62] Division of Ser. No. 364,851, May 29, 1973, Pat. No. 3,851,297.

[52] U.S. Cl. ..... 29/630 R; 29/629; 29/630 B

[51] Int. Cl.[2] ..... H01R 9/00

[58] Field of Search... 339/61 R, 61 C, 61 M, 17 M, 339/59 M, 67, 95, 154, 156, 174, 218, 182, 339/183, 199 C, 246, 249, 252, 270, 271, 339/263; 29/629, 630 R, 630 B

[56] References Cited

UNITED STATES PATENTS

| | | | |
|---|---|---|---|
| 2,874,363 | 2/1959 | Ainsworth | 339/61 M |
| 2,980,874 | 4/1961 | Tarbox | 339/17 F |
| 3,173,732 | 3/1965 | James | 339/17 LM |
| 3,444,503 | 5/1969 | Mallery | 339/61 |
| 3,638,163 | 1/1972 | Loosme | 339/17 C |
| 3,795,884 | 3/1974 | Kotaka | 29/629 |
| 3,818,414 | 6/1974 | Davies et al. | 339/17 M |

*Primary Examiner*—C. W. Lanham
*Assistant Examiner*—James R. Duzan
*Attorney, Agent, or Firm*—William J. Keating; Jay L. Seitchik; Frederick W. Raring

[57] ABSTRACT

The invention concerns connectors having an elongate spring body of elastomer or formed as a tubular spring about which a single layer wire coil is wound. The coil turns are separated by cutting the coil longitudinally of the body to define discrete conductive paths of C-shape extending round part of the circumferential profile of the body. Exposed surface portions of the wires present contact points in a row along the body. Each C-shaped turn may present a pair of diametrically opposite contacts. The coil may be wound about a former disposed beside the spring body so that on cutting the turn portions at the former leads to the individual C-shaped turn portions extend freely from the spring body.

4 Claims, 8 Drawing Figures

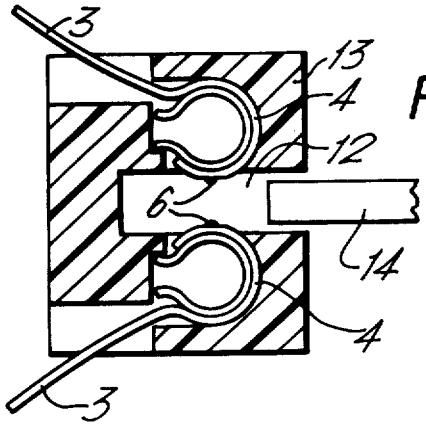
FIG.6.
FIG.7.
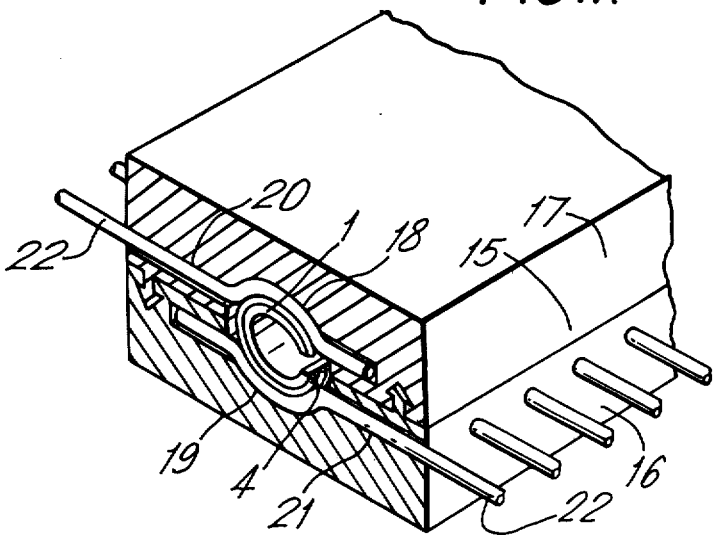
FIG.8.
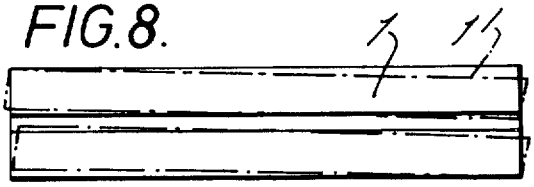

SUBSTRATE CONNECTORS

CROSS-REFERENCE TO RELATED APPLICATION

This application is a division of U.S. patent application Ser. No. 364,851, filed May 29, 1973,now U.S. Pat. No. 3,851,297.

This invention relates to electrical connectors and their method of manufacture. It is particularly but not exclusively concerned with connectors for connecting to or interconnecting lamina circuits such as are formed on printed circuit boards or substrates.

There is increasing need to effect releasable connection to circuit boards or substrates containing large numbers of integrated circuits and presenting large numbers of closely spaced connection points. It is important that such boards or substrates can readily be released from their interconnection within a greater circuit package for maintenance purposes. Conventional connectors have largely proved unsatisfactory in adaptation to the small sizes of connector and small contact pitch required.

It is an object of the present invention to provide a connector of a kind suitable for manufacture in small sizes with small contact pitch and to provide an economic manner of manufacture for such a connector.

An electrical connector according to the present invention comprises an elongate spring body having a generally uniform cross-section, which is resiliently deformable transversely of its length and which has discrete conductive paths disposed in insulating spaced relationship around the body, in which each path comrises a conductor wire of generally C-shaped turn form extending around part only of the circumferential periphery of and bonded to the body, exposed surface portions of the wire turns defining at least a row of contact points distal from and extending along the spring body.

In one embodiment the wire of each C-shaped turn of at least one of the ends of the C-shape extends freely away from the spring body as a lead.

Suitably, the C-shaped turns extend around more than half of the circumferential periphery of the body and present diametrically opposite rows of contact points extending longitudinally of the body.

The spring body may be formed of elastomeric insulating material or for example it may be formed as a tubular spring of C-shaped cross-section. Such a spring may be of metal in which case the spring turns are insulated from the metal.

In a method of manufacture of an electrical connector according to the present invention, a single layer coil of conductor wire is wound around the spring body to extend longitudinally in closely spaced turns, the turns being bonded to the body and the coil being cut longitudinally of the body to separate adjacent turns which define the discrete conductive paths.

In a particular form of this method, the spring body is initially located beside a former body extending longitudinally of and projecting laterally from the spring body, the coil being wound in turns about the two bodies and cut longitudinally of the coil at turn portions around the former body, the former body being removed and wire portions extending from one or both ends of each of the separated turns. Suitably, a pair of connectors may be made simultaneously by disposing a former body between a pair of spring bodies, and winding the coil about the three bodies. The turns are then cut longitudinally of the former at locations between the spring bodies.

In order to reduce the offset effect due to the helical nature of coil turns, the spring body is suitably elastically deformed prior to winding the coil in the same sense as the lead of the coil, and is held in that condition until after the coil cutting operation when the deformation is relaxed. The coil turns are thus flattened.

The invention will now be described by way of example with reference to the accompanying partly diagrammatic drawings, in which:

FIG. 6 is a sectional view of a printed circuit edge connector embodying connectors according to FIGS. 1 and 2;

FIG. 7 is a fragmentary perspective view partially sectioned of a connector block assembly embodying the invention; and FIG. 8 is an elevation of a spring body in relaxed and deformed conditions established during manufacture of a connector according to the invention.

Figure 1:
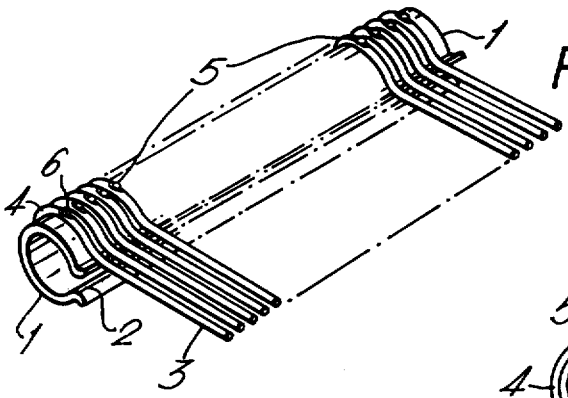
FIG. 1 is a perspective view of a connector.
Figure 4:
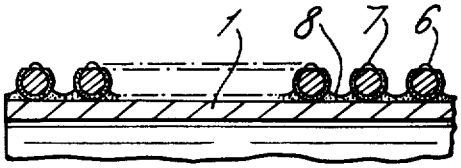
FIG. 4 is an enlarged fragmentary longitudinal section of part of the connector of FIGS. 1 and 2.

The connector of FIG. 1 comprises a tubular spring member 1 having a generally C-shaped cross-section with a longitudinally extending open seam 2 which may be closed by resilient deformation of the spring. The tubular spring is of metal but alternatively it could be of resilient insulating material or a body of elastomeric insulating material could be substituted for the tubular spring. A series of parallel wires 3 extend generally tangentially from the spring 1 and the wires terminate with arcuate portions 4 extending around and bonded to the tubular spring 1 in insulating spaced relationship. The wires are suitably insulated with a varnish type insulation and diametrically opposite parts of the arcuate portions 4 are cleaned of insulation on sides distal from the spring 1. The bare metal exposed is spot plated with contact metal such as gold or tin at 7 to provide rows 5 of contact points 6. The adhesive bonding material as seen in FIG. 4 secures the arcuate portions in insulating space relationship and allows flexure of the arcuate portions 4 concomitant with flexure of the tubular spring 1.

Figure 2:
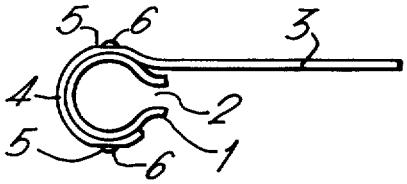
FIG. 2 is an end view of the connector of FIG. 1.
Figure 3:
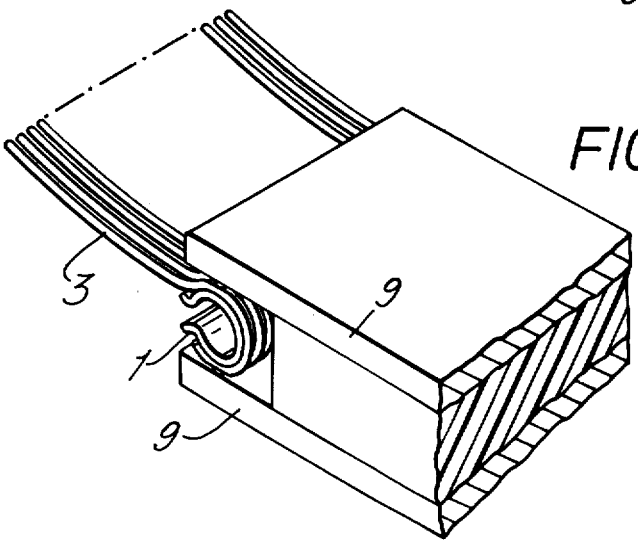
FIG. 3 is a fragmentary perspective view of a printed circuit board assembly including a connector according to FIGS. 1 and 2.

In use, as seen in FIG. 3, the connector of FIGS. 1 and 2 is clamped between opposed faces of adjacent circuit boards 9 with the tubular spring 1 compressively flexed between the boards. Groups of contact points 6 engage respective contacts of the circuit boards to effect desired interconnections between the upper and lower boards and to input or output circuits through the lead wires 3.

Figure 5:
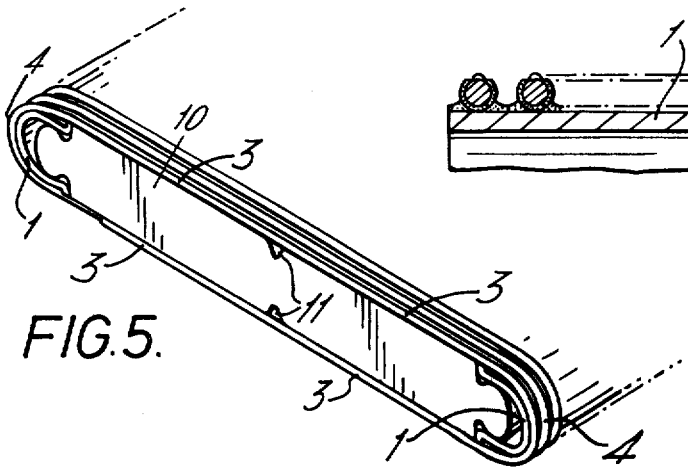
FIG. 5 is a fragmentary perspective view of a stage in the manufacture of a connector according to FIGS. 1 and 2.

In order to manufacture a connector of this kind, as seen in FIG. 5, tubular springs 1 are suitably sprung onto opposite ends of a former 10 adapted to open the spring seams 2. The former is provided with longitudinal grooves 11 at opposite sides for wire cutting purposes as will be described. The external arcuate surfaces of the springs are coated with adhesive 8, FIG. 4, and a single layer coil of wire wound around the former in a series of closely spaced turns. After setting of the bonding adhesive, desired contact points 6, FIG. 4, are cleaned by a skimming or grinding process and the exposed wire portions spot plated with a suitable contact metal 8, such as gold or tin. The wire coil is cut along the grooves 11 to separate the two connectors which are then removed from the former 10.

The wire ends 3 extend from both sides of the open seam 2 each connector, and due to the expansion of these seams during the manufacture, the arcuate portions 4 of the wires extend around more than a semicircle when the spring is relaxed. The contact rows are suitably diametrically opposite in this condition. The wire ends 3 may be selectively removed or grouped into bundles according to the particular circuit connections required.

In the edge connector of FIG. 6 a pair of connectors according to FIGS. 1 and 2 is positioned one on each side of a slot 12 in a housing 13. The springs 1 are arranged with arcuate portions projecting into the slot 12 with the rows of contact points 6 disposed to engage opposite sides of a printed circuit board 14. The wire ends 3 lead out from the housing for circuitry connection purposes.

It will be appreciated that the manufacture of the connector by coil winding techniques will normally result in diametrically opposite contact points 6 of a conductor portion 4 being helically offset by half of a pitch. Where fine wires are used on a close pitch and it is intended that a complementary contact surface of a printed circuit board will engage a plurality of contact points as a group, the half pitch offset is not material.

However, in situations where it is intended that the complementary printed circuit or substrate circuit will engage but a single contact point 6 then precautions must be taken to ensure selection of the appropriate contact points on diametrically opposite portions of the connector. In such situations it may be desirable to wind the arcuate portions 4 as flat turns or after winding the coil to displace marginal portions of the C-shaped spring bordering the open seam laterally in opposite directions in order to flatten the coil turns. This may suitably be effected by initially stressing the spring laterally in the sense of coil winding, in order elastically to deform the spring by an amount corresponding to the coil pitch and after winding the coil and bonding the turns, allowing the spring to relax from the stress to flatten the turns.

In an embodiment of the invention as shown in FIG. 7, the connector spring body is contained in an insulating housing 15 comprising indentical halves 16, 17 snap-fitting together and about the spring body 1. Each housing half 16, 17 contain means, not shown, to engage ends of the spring body 1 at each side of the seam and arranged on closure of the two housing halves 16, 17 together to displace marginal portions of the spring body on each side of the seam relatively laterally in order to flatten the coil turns 4.

Each housing half 16, 17 has a groove-like recess 18, 19 receiving the spring body 1, and a plurality of passageways 20, 21 extending transversely of the recess and intersecting the recess generally tangentially of the spring body. Conductor wires 22 may be threaded into the passageways and clamped in position by resilient pressure of the spring body 1 which provides mechanical retention and contact pressure. Such an arrangement is applicable to flat flexible or tape cables, in which case a slot is provided for reception of the multiconductor cable in place of a plurality of passageways 22.

In FIG. 8 a spring body 1 of C-shaped section showing in broken lines 1' how it may be elastically deformed by lateral displacement on opposite sides of the seam prior to coil winding so that on relaxation afterwards, the helical coil turns are flattened. It will be appreciated that the broken line position represents a single turn helix of the same pitch and lead sense as the coil winding.

What is claimed is:

1. A method of manufacturing an electrical connector comprising the steps of providing an elongate spring body having a generally uniform cross-section which is resiliently deformable transversely of the body length, locating a former body beside the spring body whereby the former body extends longitudinally of and projects laterally from the spring body, winding a single layer coil of conductor wire around the spring body and the former body to extend longitudinally in closely spaced turns, bonding the turns to the spring body, cutting the coil longitudinally at turn portions around the former body and spaced from the spring body to separate adjacent turns thereby defining discrete conductive paths disposed in insulating spaced relationship around the spring body and integral lead conductors extending from the turns on the spring body to the cut portion on the former body, and removing the former body from the spring body.

2. A method as set forth in claim 1 further comprising the step elastically deforming the spring body in the same sense as the lead of the coil prior to winding the coil, and holding the spring body in the elastically deformed condition until after the coil cutting operation when the deformation is relaxed and the coil turns thereby flattened.

3. A method as set forth in claim 1 further comprising the step of locating a second spring body beside the former body and opposite to the first spring body, and winding the coil around both spring bodies and former body.

4. A method as set forth in claim 1 further comprising the step of cleaning portions of the coil turns exposed externally of the spring body to expose bare metal portions in a row extending longitudinally of the spring body, and spot plating the bare metal portions to define contact points.

* * * * *